US008225563B2

(12) United States Patent
Lajewski

(10) Patent No.: US 8,225,563 B2
(45) Date of Patent: Jul. 24, 2012

(54) ADJUSTABLE HOUSING ASSEMBLY

(75) Inventor: Todd M. Lajewski, Lapeer, MI (US)

(73) Assignee: Tapco International Corporation, Wixom, MI (US)

( * ) Notice: Subject to any disclaimer, the term of this patent is extended or adjusted under 35 U.S.C. 154(b) by 0 days.

(21) Appl. No.: 13/149,428

(22) Filed: May 31, 2011

(65) Prior Publication Data

US 2011/0225900 A1 Sep. 22, 2011

Related U.S. Application Data

(62) Division of application No. 12/489,216, filed on Jun. 22, 2009, now Pat. No. 7,950,195, which is a division of application No. 10/932,664, filed on Sep. 2, 2004, now Pat. No. 7,549,258.

(60) Provisional application No. 60/499,440, filed on Sep. 2, 2003.

(51) Int. Cl.
*E04C 2/52* (2006.01)

(52) U.S. Cl. ..... 52/220.8; 52/220.1; 52/302.1

(58) Field of Classification Search ..... 52/220.8, 52/220.1, 302.1, 302.6, 302; 439/544, 546, 439/549, 552, 555, 557
See application file for complete search history.

(56) References Cited

U.S. PATENT DOCUMENTS 947,185 A 1/1910 McBean
4,441,404 A 4/1984 Simon
4,875,318 A 10/1989 MacLeod et al.
4,896,590 A 1/1990 Groos
4,920,708 A 5/1990 MacLeod et al.
5,326,060 A 7/1994 Chubb et al.
5,397,093 A 3/1995 Chubb et al.
5,491,936 A 2/1996 Logan et al.
5,549,266 A 8/1996 Mitchell et al.
5,560,163 A 10/1996 Carlton
5,577,702 A 11/1996 Chubb et al.
5,596,852 A 1/1997 Schiedegger
5,722,208 A 3/1998 Humphrey et al.
5,727,703 A 3/1998 Fuchs
5,729,935 A 3/1998 Schiedegger et al.
5,918,431 A 7/1999 Schiedegger et al.
6,168,035 B1 1/2001 McLelland
6,299,661 B1 10/2001 Bloomer
6,310,287 B1 10/2001 Schiedegger et al.
6,383,072 B2 5/2002 Schiedegger et al.
6,740,813 B1 5/2004 Gretz

*Primary Examiner* — Jeanette E Chapman
*Assistant Examiner* — Daniel Kenny
(74) *Attorney, Agent, or Firm* — Quinn Law Group, PLLC

(57) ABSTRACT

An adjustable housing assembly for mounting to a wall is disclosed. The assembly generally includes a back plate having a flange that defines an axis extending perpendicularly from the back plate and a front plate disposed in parallel relationship to the back plate. A connector connects the plates in the parallel relationship at various distances longitudinally along the axis. The connector includes co-acting male and female components extending circumferentially about the axis and at least one of the male and female components is spaced longitudinally along the axis for connecting the plates at any one of the various distances in response to relative rotation between the male and female components about the axis. The connector may also include a mounting ring separate from the back plate and the front plate that couples the front plate to the back plate. The mounting ring allows for additional distances to be obtained between the front plate and the back plate.

24 Claims, 9 Drawing Sheets

ADJUSTABLE HOUSING ASSEMBLY

CROSS-REFERENCE TO RELATED APPLICATIONS

This application is a divisional of U.S. patent application Ser. No. 12/489,216 filed Jun. 22, 2009, now U.S. Pat. No. 7,950,195, which is a divisional of U.S. patent application Ser. No. 10/932,664 filed Sep. 2, 2004, now U.S. Pat. No. 7,549,258, which claims priority to U.S. Provisional Patent Application No. 60/499,440 filed on Sep. 2, 2003, each of which are incorporated herein by reference.

BACKGROUND OF THE INVENTION

1. Field of the Invention

The subject invention provides an adjustable housing assembly for mounting to a wall, and more specifically to an adjustable housing assembly having a front plate that is removable and that is adjustable between intermediate positions for accommodating various thicknesses of building material on the wall.

2. Description of the Prior Art

Various prior art housing assemblies are known to those skilled in the art for mounting to a wall. These assemblies include a back plate, a front plate, and a connector connecting the back and the front plate. The housing assemblies are typically used for electrical outlets, light fixtures, plumbing fixtures, decorative assemblies, and the like. The connector establishes various distances between the plates to accommodate different building materials disposed on the wall.

One such assembly is shown in U.S. Pat. No. 5,729,935 for a gable vent. The gable vent has a mounting ring positioned over an opening in a wall having siding thereon. A cover member mates with the mounting ring and is adjustable to accommodate different thicknesses of siding. The mounting ring has a plurality of grooves that are axially spaced for engaging shoulder portions of the cover member. The distances between the cover member and the mounting ring are established depending upon which groove the shoulder portion engages. In operation, the cover member is aligned with the mounting ring and a force perpendicular to the cover member is applied to engage the shoulder portions with the grooves. The distances between the cover member and the mounting ring are limited to the distances between the grooves in the mounting ring. Additionally, in order to remove and/or change the cover member, the siding is removed to gain access to the grooves to disengage the shoulder portions.

Another assembly is shown in U.S. Pat. No. 5,918,431 and discloses a base member and a cover member having inter-engaging portions that permit the cover member to be adjustably spaced from the base member to accommodate sidings of various thickness. The inter-engaging portions include notches or recesses in the base member and shoulder portions in the cover member. Typically there are multiple notches axially spaced for receiving the shoulder portions. The cover member is aligned with the base member and a force perpendicular to the cover member is applied to force the shoulder portions into the desired notch or recess depending upon the thickness of the building material.

SUMMARY OF THE INVENTION AND ADVANTAGES

The subject invention provides an adjustable housing assembly for mounting to a wall. The assembly comprises a back plate, a front plate, and a connector connecting the front plate to the back plate. The back plate has a flange defining an axis extending perpendicularly from the back plate. The front plate is disposed in parallel relationship to the back plate and the connector connects the plates in the parallel relationship at various distances longitudinally along the axis. The connector includes co-acting male and female components that extend circumferentially about the axis and at least one of the male and female components are spaced longitudinally along the axis for connecting the plates at any one of the various distances in response to relative rotation between the male and female components about the axis.

The subject invention connects the plates at various distances and allows the distance to be adjusted between the plates to fit the particular building material. The subject invention also provides for convenient removal and/or replacement of the front plate without having to remove the building material from the wall. This is particularly useful to change aesthetics by adding a different front plate to the already existing back plate.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1A:
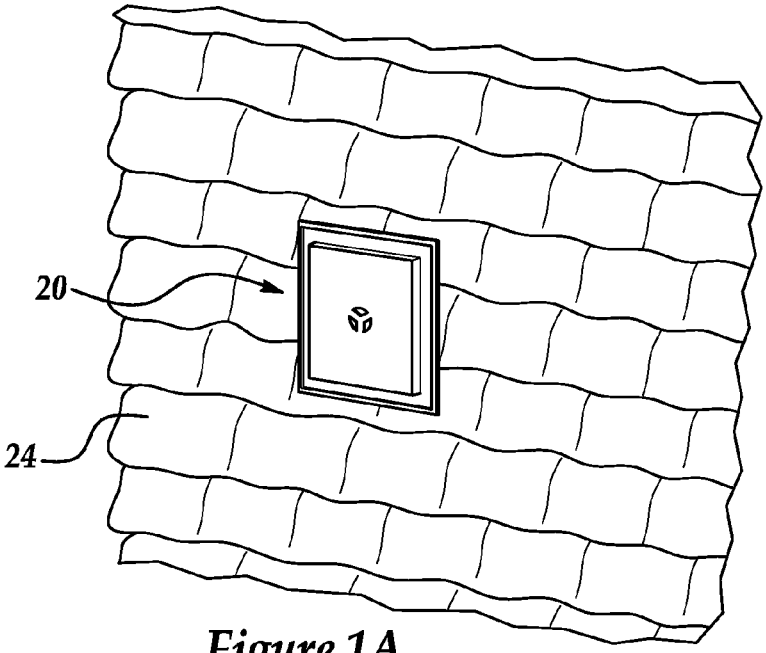
FIG. 1A is an environmental view of a building having a housing assembly mounted thereto.

The subject invention provides an adjustable housing assembly for mounting to a wall 22 and is shown generally in FIG. 1A at 20. The assembly 20 is particularly useful for accommodating various thicknesses of building materials 24 disposed on the wall 22, such as, different thicknesses of siding, insulation, and the like. The assembly 20 is typically used for electrical outlets, light fixtures, plumbing fixtures, decorative assemblies, venting assemblies and the like.

Figure 1B:
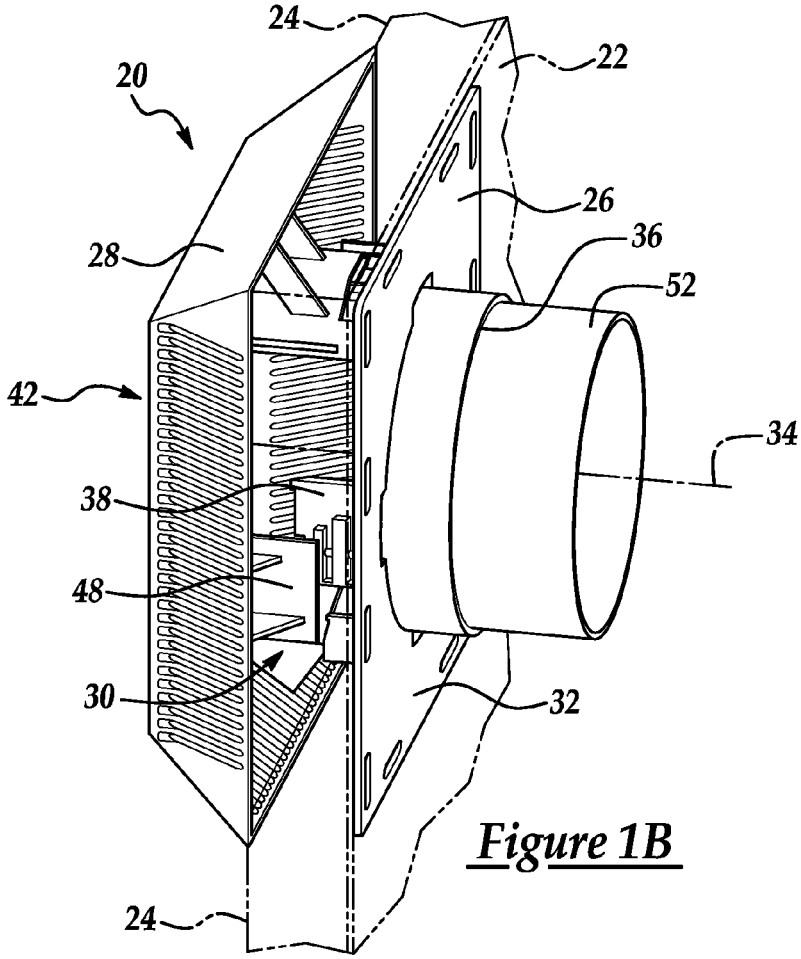
FIG. 1B is a perspective view of a housing assembly for use with an exhaust vent.

Referring to FIG. 1B, the assembly 20 generally includes a back plate 26, a front plate 28, and a connector 30 connecting the front plate 28 and the back plate 26. The back plate 26 has a flange 32 and defines an axis 34 extending perpendicularly from the back plate 26. Preferably, the flange 32 extends radially about an aperture 36. The back plate 26 is secured to the wall 22 by any means known to those skilled in the art, such as, but not limited to, fasteners and adhesives. The aperture 36 allows various members running within the wall 22 to extend through the wall 22 while still being aesthetically appealing. For example, if the assembly 20 is used to mount a light fixture to the wall 22, then the aperture 36 may allow electrical conduit to extend through for connecting to the light fixture. A further example would allow plumbing to extend through the aperture 36 for connection to plumbing fixtures.

The front plate 28 is disposed in parallel relationship to the back plate 26. Preferably, the front plate 28 covers the aperture 36. The front plate 28 may be substantially planar or may have recesses depending upon the application. For example, the front plate 28 may include the recess for housing 20 the plumbing fixtures or may be substantially planar for mounting the light fixture thereto. Additionally, the front plate 28 may comprise a vent hoods for dryer exhausts 42 as understood by those skilled in the art.

The connector 30 connects the plates 26, 28 in the parallel relationship at various distances 40 longitudinally along the axis 34. In other words, the connector 30 allows the distance to be adjusted between the plates 26, 28 to fit the particular building material 24. The connector 30 also provides for convenient removal and/or replacement of the front plate 28 without having to remove the building material 24 from the wall 22. This is particularly useful to change the aesthetics by adding a different front plate 28 to the already existing back plate 26. In order to allow such removal, the connector 30 includes co-acting male and female components 43, 44 extending circumferentially about the axis 34. As shown and described herein, the female components 44 are spaced longitudinally along the axis 34 for connecting the plates 26, 28 at any one of the various distances 40 in response to relative rotation between the male and female components 43, 44 about the axis 34. However, it should be appreciated that the male components 43 may alternatively be spaced longitudinally along the axis 34 for connecting the plates 26, 28 at any one of the various distances 40 in response to relative rotation between the male and female components 43, 44 about the axis 34.

Figure 2:
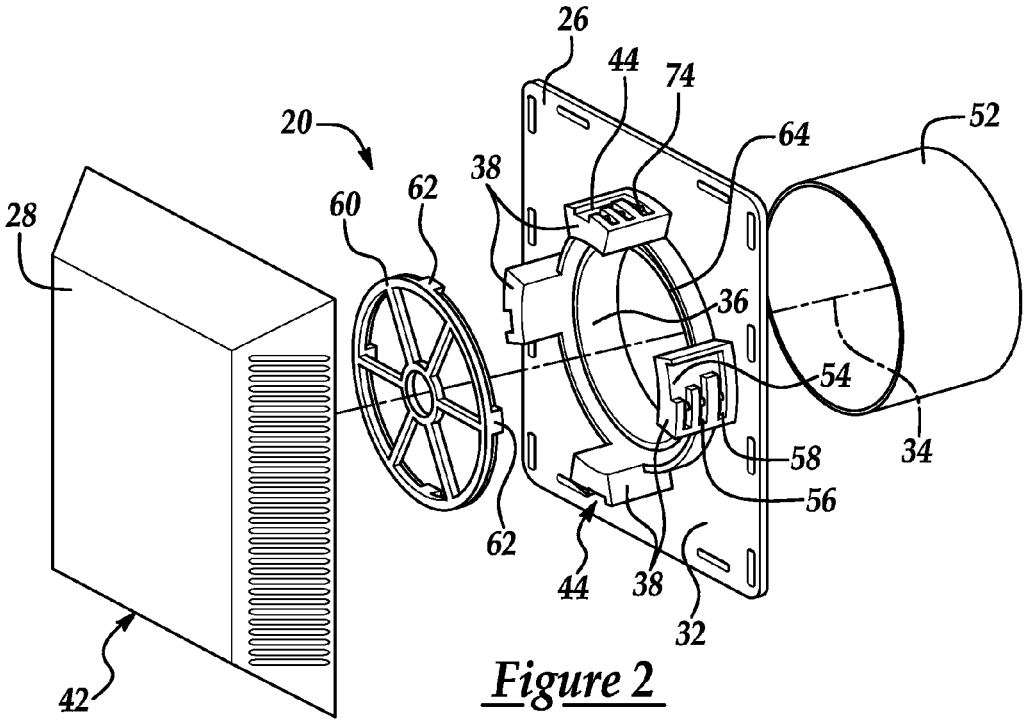
FIG. 2 is an exploded view of the assembly shown FIG. 1.

Referring to FIG. 2, the back plate 26 has a securing member 38 extending from the flange 32 that extends circumferentially about the axis 34 on the flange 32. The securing member 38 may also extend continuously or discontinuously about the axis 34 depending upon the particular application. The securing member 38 may extend continuously about the axis 34 and outwardly from the flange 32. The female component 44 may extend from the securing member 38 such that the female component 44 and the securing member 38 are integrally formed. Those skilled in the art recognize that the female component 44 and the securing member 38 may be formed separately without deviating from the subject invention.

Figure 3:
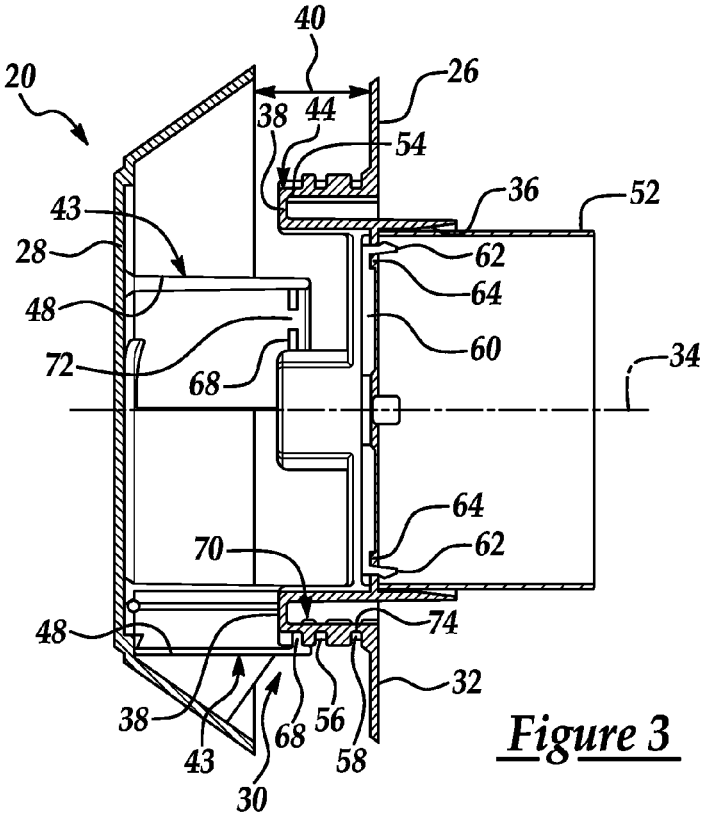
FIG. 3 is a cross-sectional view of the assembly shown in FIG. 1.

With reference to FIG. 3, the front plate 28 has an attachment portion 48 extending from the front plate 28 for attachment to the back plate 26. As discussed above, the front plate 28 is removable from the back plate 26 for allowing aesthetic changes. Preferably, the attachment portion 48 extends circumferentially about the axis 34. The male component 43 extends from the attachment portion 48 and is integrally formed therewith. Those skilled in the art recognize that the male component 43 and the attachment portion 48 may be formed separately without deviating from the subject invention.

Referring to the embodiment shown in FIGS. 1-3, the assembly 20 is illustrated for use with an exhaust vent 52. The aperture 36 of the back plate 26 mounts about an exhaust 52 that extends through the wall 22. FIG. 2 is an exploded view of the assembly 20 shown FIG. 1 and FIG. 3 is a cross-sectional view of the assembly 20 shown in FIG. 1. The front plate 28 acts as a cover to prevent items from entering the exhaust 52. The female component 44 of the securing member 38 includes a first locking channel 54, a second locking channel 56, and a third locking channel 58. Each of the locking channels 54, 56, 58 is longitudinally spaced along the axis 34 such that each locking channel 54, 56, 58 establishes a different distance 40 between the front plate 28 and the back plate 26. The subject invention may include more or fewer locking channels depending upon the application. In the embodiment shown, the front plate 28 may be adjusted between three different distances based upon the selection of one of the three locking channels 54, 56, 58. The locking channels are also illustrated as spaced circumferentially and discontinuously about the axis 34. In other words, the locking channels do not extend continuously about the aperture 36, instead there are four discrete areas having the locking channels 54, 56, 58.

Referring again to FIG. 2, a screen 60 may also be supported by the back plate 26 for preventing animals, such as birds, from entering the exhaust 42. The screen 60 may be press fit into the aperture 36 as understood by those skilled in the art. In the embodiment shown, the screen 60 has tangs 62 and the aperture 36 has a raised portion 64 for engaging the tangs 62, such that the screen 60 is pressed into the aperture 36 and the tangs 62 engage the raised portion 64.

The male components 43 of the attachment portion 48 are illustrated as shoulder portions 68 that extend from the attachment portions 48, which are best shown in FIG. 3. A locking mechanism 70 includes locking detents 72 on the shoulder portions 68 and locking fingers 74 on the locking channels 54, 56, 58. It is preferred that the locking fingers 74 are positioned every 90 degrees about the securing member 38 such that when the front plate 28 is locked it will be parallel to the back plate 26. However, other configurations are contemplated where the front plate 28 may be at various angles relative to the back plate 26.

In operation, the back plate 26 is mounted to the wall 22 and the screen 60 is mounted to the base. Next, the shoulder portions 68 are aligned with the desired locking channels 54, 56, 58 and then the front plate 28 is rotated to lock the plates 26, 28 to one another. When the front plate 28 is rotated, the locking finger 74 engages the locking detent 72 to secure the front plate 28 thereto. If the front plate 28 was to be removed or replaced, the front plate 28 would be rotated in the opposite direction to disengage the shoulder portions 68 from the locking channels 54, 56, 58 and then removed.

Referring to FIGS. 4-16, the assembly 20 is illustrated as having the connector 30 including a mounting ring 76. The mounting ring 76 is separate from the back plate 26 and the front plate 28 and couples the front plate 28 to the back plate 26. The mounting ring 76 allows for additional distances 40 to be obtained between the front plate 28 and the back plate 26. Another advantage is that the mounting ring 76 can be used to retrofit older assemblies 20 with new front plates 28 without having to remove the existing back plate 26 and without having to remove any building material 24 to do so. In order for the mounting ring 76 to couple the plates 26, 28 to one another, the mounting ring 76 has at least one male 45 and female component 47 for connection with the securing member 38 and the attachment portion 48. The mounting ring 76 may have two male components, two female components, or one male 45 and one female component 47, depending upon the configuration of the front plate 28 and the back plate 26. The mounting ring 76 may also be used to connect to a female back plate with a female front plate, or vice versa.

Figure 4:
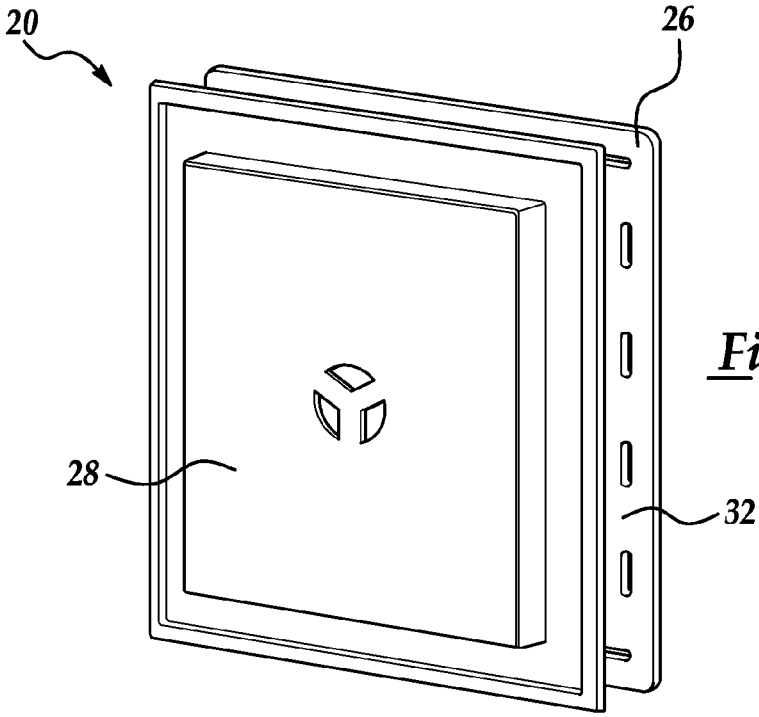
FIG. 4 is a perspective view of another embodiment of the assembly according the subject invention.
Figure 5:
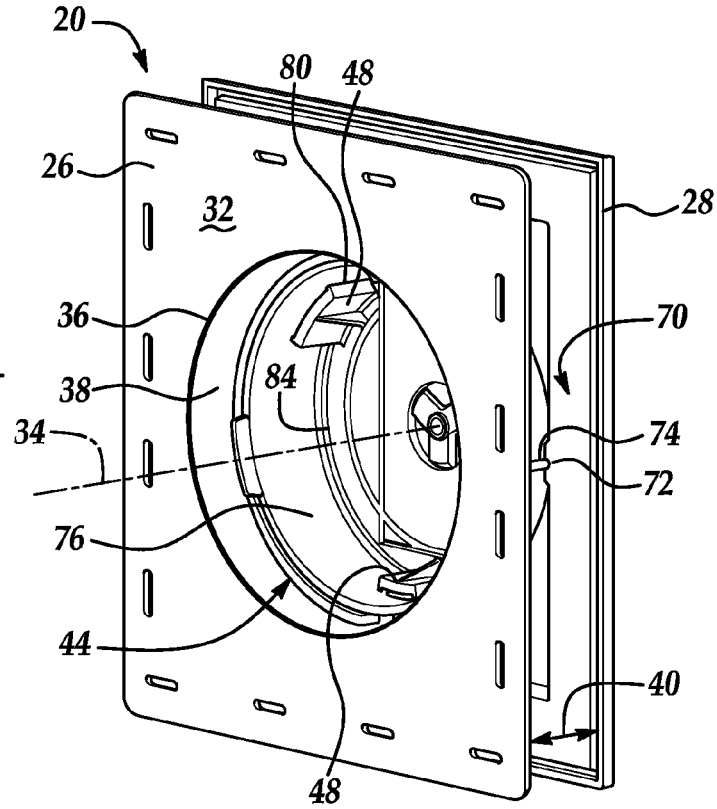
FIG. 5 is a rear perspective view of the assembly shown in FIG. 4.
Figure 6:
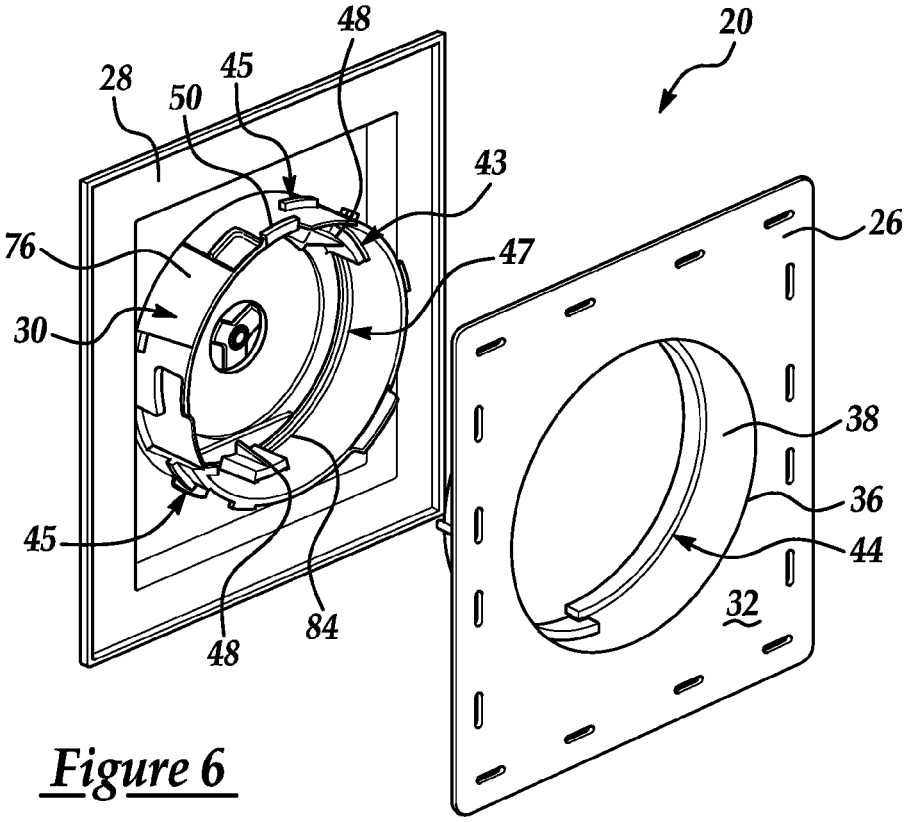
FIG. 6 is a partial exploded view having a mounting ring connected with a front plate and having a back plate removed.
Figure 7:
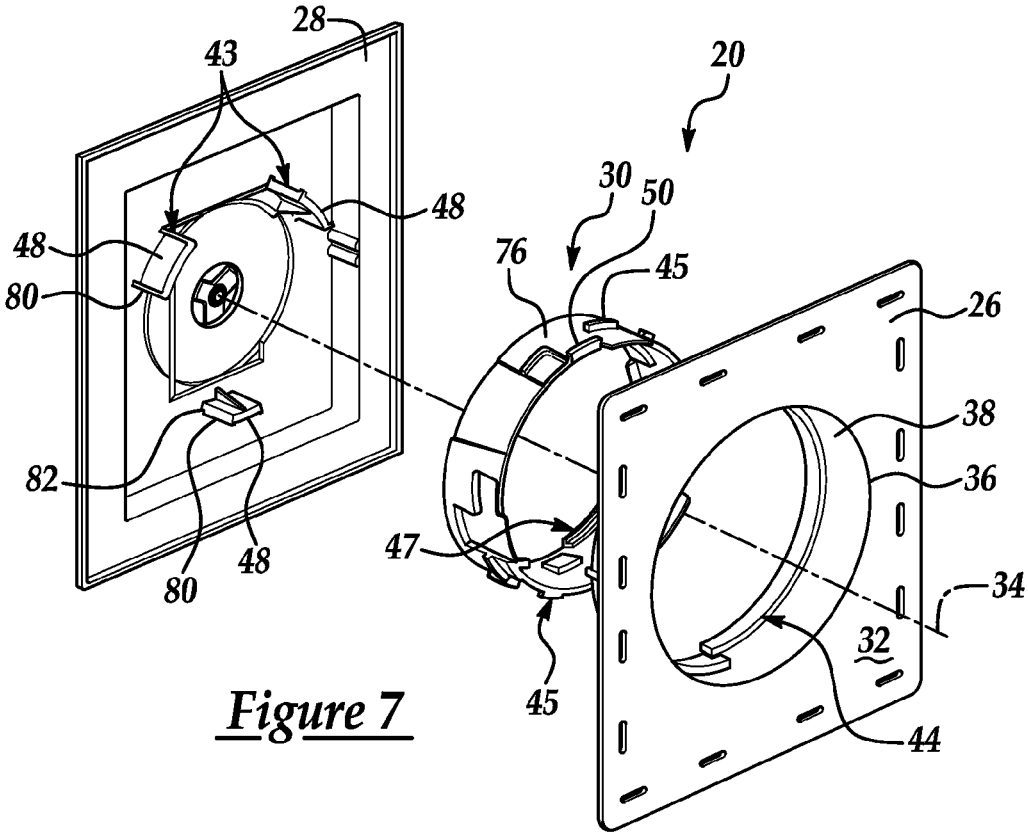
FIG. 7 is an exploded view of the assembly shown in FIG. 4.

With specific reference to the embodiment shown in FIGS. 4-7, the male component 43 of the attachment portion 48 and the female component 47 of the mounting ring 76 creates a snap-fit connection therebetween. FIG. 4 is a perspective view the front plate 28 being secured to the back plate 26 and FIG. 5 is a rear perspective view of the assembly 20. FIG. 6 is a partial exploded view having the mounting ring 76 connected with the front plate 28 and the back plate 26 is removed. FIG. 7 is an exploded view of the assembly 20.

The male component 43 of the attachment portion 48 is discontinuously and circumferentially spaced about the front plate 28 and includes a ramped surface 80 having a lip detent 82. There are three attachment portions 48 illustrated in FIG. 7. The female component 47 of the mounting ring 76 may be discontinuously spaced circumferentially about the mounting ring 76 or continuous. The female component 47 of the mounting ring 76 is illustrated as a continuous, raised lip 84 for engaging the lip detent 82 and creating the snap-fit connection therebetween. To connect the mounting ring 76 to the front plate 28, the raised lip 84 biases the attachment portions 48 inwardly by engaging the ramped surfaces 80. Then, the raised lip 84 engages the lip detent 82 and the attachment portions 48 snap outwardly.

The mounting ring 76 also includes the male components 45 for connecting with the female components 44 of the securing member 38. The male component 45 of the mounting ring 76 and female component 44 of the securing member 38 are illustrated as threads. It is obvious to those skilled in the art that the threads of the mounting ring 76 and the securing member 38 may be described as either female or male components. Therefore, the subject invention is not limited to the terms of female and male and these terms are to designate the respective location and not the specific functionality. The threads of the mounting ring 76 are discontinuously spaced circumferentially about the mounting ring 76. The threads of the mounting ring 76 are also axially spaced such that when the mounting ring 76 is rotated relative to the back plate 26, the distance between the front plate 28 and the back plate 26 is changed. It is to be appreciated that the threads of the mounting ring 76 may be a single continuous thread, instead of a discontinuous thread. The mounting ring 76 may also include a stop thread 50 for preventing the mounting ring 76 from being threaded past the back plate 26. The stop thread 50 may engage either one of the top of the securing member 38 or the female components 44 of the securing member 38 to prevent over rotation.

Referring to back to FIG. 5, the locking mechanism 70 locks the connector 30 in a locked position as the connector 30 is rotated relative to at least one of the front plate 28 and the back plate 26. Specifically, the front plate 28 includes the locking detent 72 and the securing member 38 includes the locking finger 74 similar to those described above. When the mounting ring 76 is rotated, the locking finger 74 of the securing member 38 engages the locking detent 72 to lock the front plate 28 in that orientation.

Figure 8:
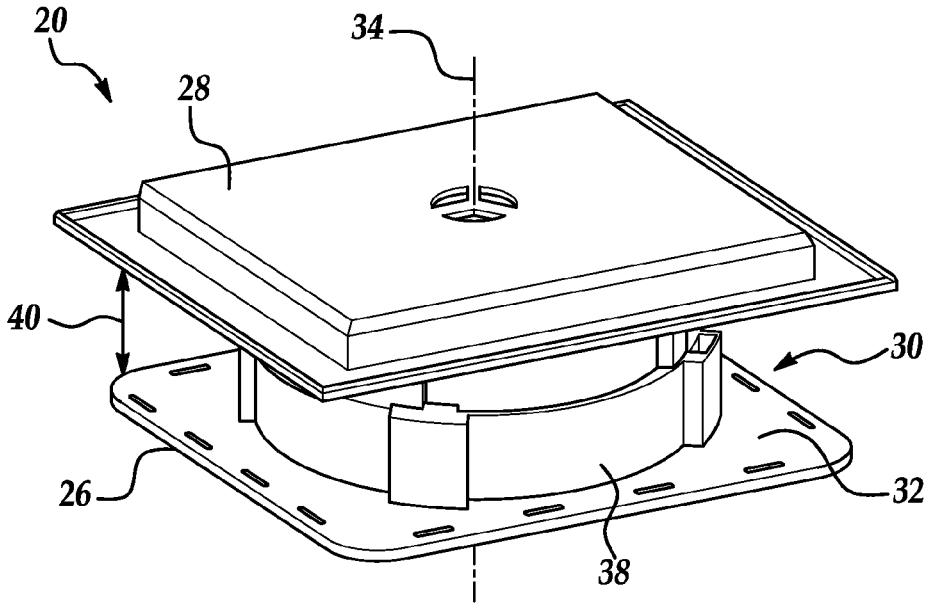
FIG. 8 is a front perspective view of yet another assembly according to the subject invention.
Figure 9:
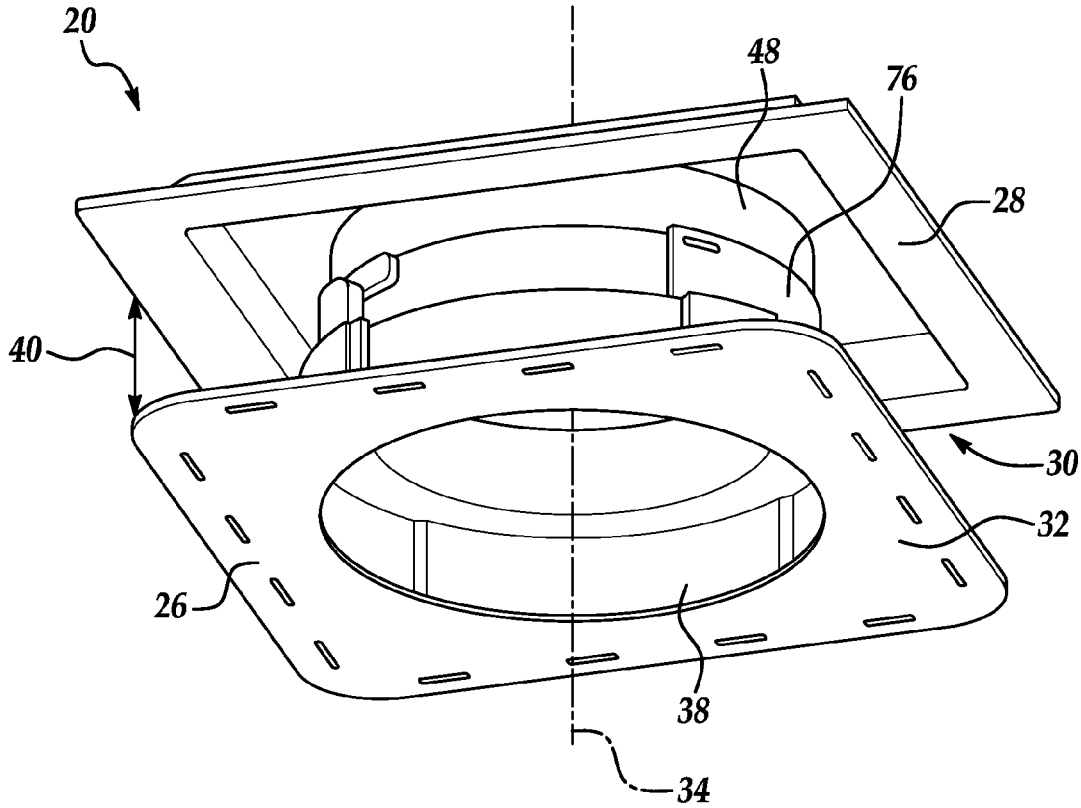
FIG. 9 is a rear perspective view of the assembly shown in FIG. 8.

Yet another embodiment of the subject invention is illustrated in FIGS. 8-11. The assembly 20 includes the female component 44 of the securing member 38 having locking channels 54, 56, 58 longitudinally spaced along and circumferentially about the axis 34, shown best in FIGS. 10 and 11. It is preferred that the locking channels 54, 56, 58 are discontinuously spaced circumferentially about the axis 34. The locking channels 54, 56, 58 are similar to those described above and shown in FIG. 2. FIG. 8 is a front perspective view of the assembly 20 and FIG. 9 is a rear perspective view of the assembly 20.

Figure 10:
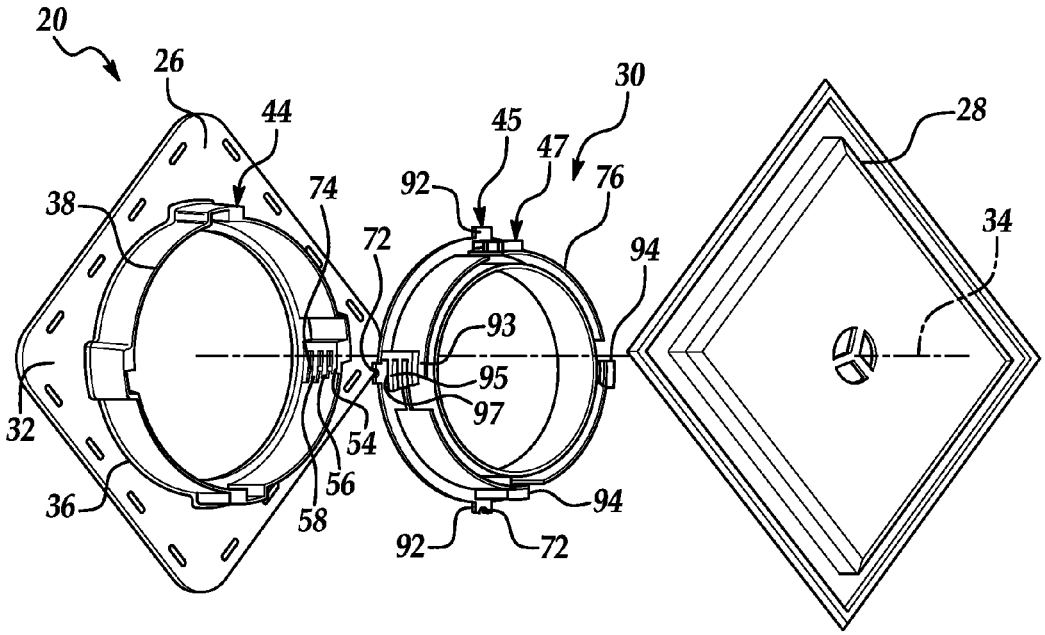
FIG. 10 is an exploded rear view of the assembly shown in FIG. 8.
Figure 11:
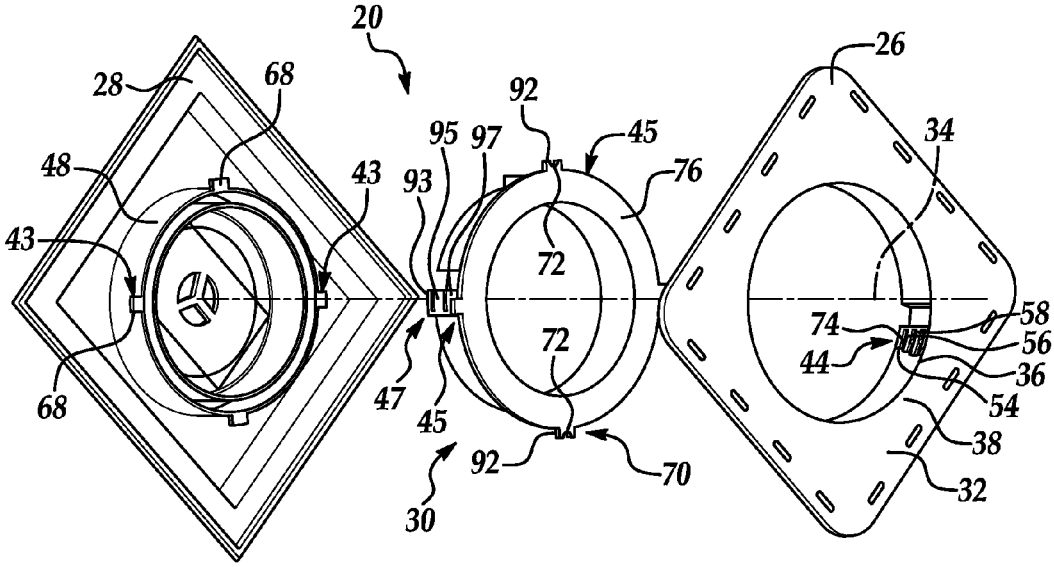
FIG. 11 is an exploded front view of the assembly shown in FIG. 8.

Referring to FIG. 10, an exploded rear view of the assembly 20 of FIG. 8 is shown. FIG. 11 is an exploded front view of the assembly 20. The male component 45 of the mounting ring 76 includes tabs 92 extending outwardly from the mounting ring 76 for engaging the locking channels 54, 56, 58. The locking channel 54, 56, 58 is selected based upon the distance required between the front plate 28 and the back plate 26 by positioning the tab 92 adjacent the locking channel 54, 56, 58. The mounting ring 76 is then rotated to lock the tab 92 in the locking channel 54, 56, 58.

The female component 47 of the mounting ring 76 includes locking slots 94 longitudinally spaced along and circumferentially about the axis 34. Preferably, the mounting ring 76 includes at least a first 93 and a second locking slot 95 and most preferably also includes a third locking slot 97. The combination of the three locking slots 94 with the three locking channels 54, 56, 58 allows the assembly 20 to establish nine different distances 40 between the front plate 28 and the back plate 26. The locking slots 94 are preferably discontinuously spaced circumferentially about the axis 34 and each of the locking slots 94 extend circumferentially about the axis 34 a different amount for locating the tabs 92 of the mounting ring 76 in one of the locking slots 94. It is preferred that the locking slots 94 are discontinuously spaced circumferentially about the mounting ring 76.

The male component 43 of the attachment portion 48 shown in FIG. 10 are shoulder portions 68 similar to that shown in FIG. 2. The shoulder portions 68 extend from the attachment portion 48 for engaging the locking slots 94. In operation, after or before the mounting ring 76 has been connected to the back plate 26, the shoulder portions 68 are aligned with one of the locking slots 94 to establish the desired distance and then rotated to lock the shoulder portions 68 in the locking slot 94.

Figure 12:
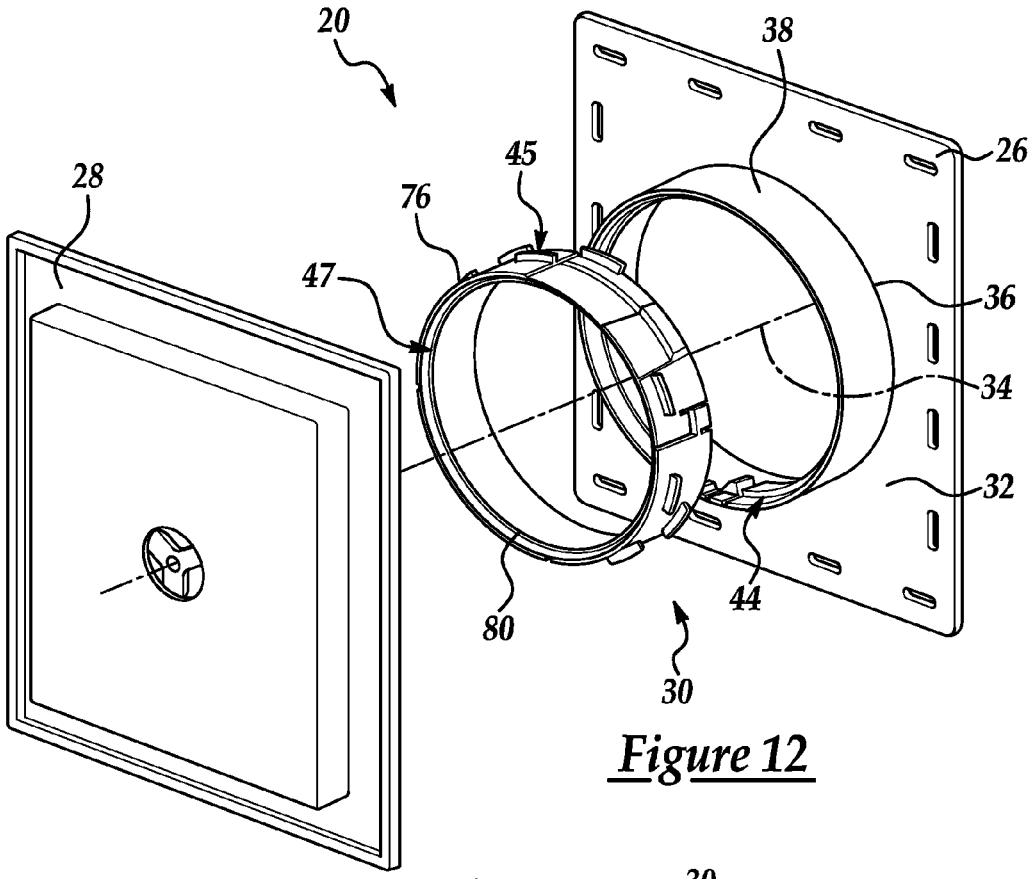
FIG. 12 is an exploded view of still another embodiment of the assembly according to the subject invention.
Figure 13:
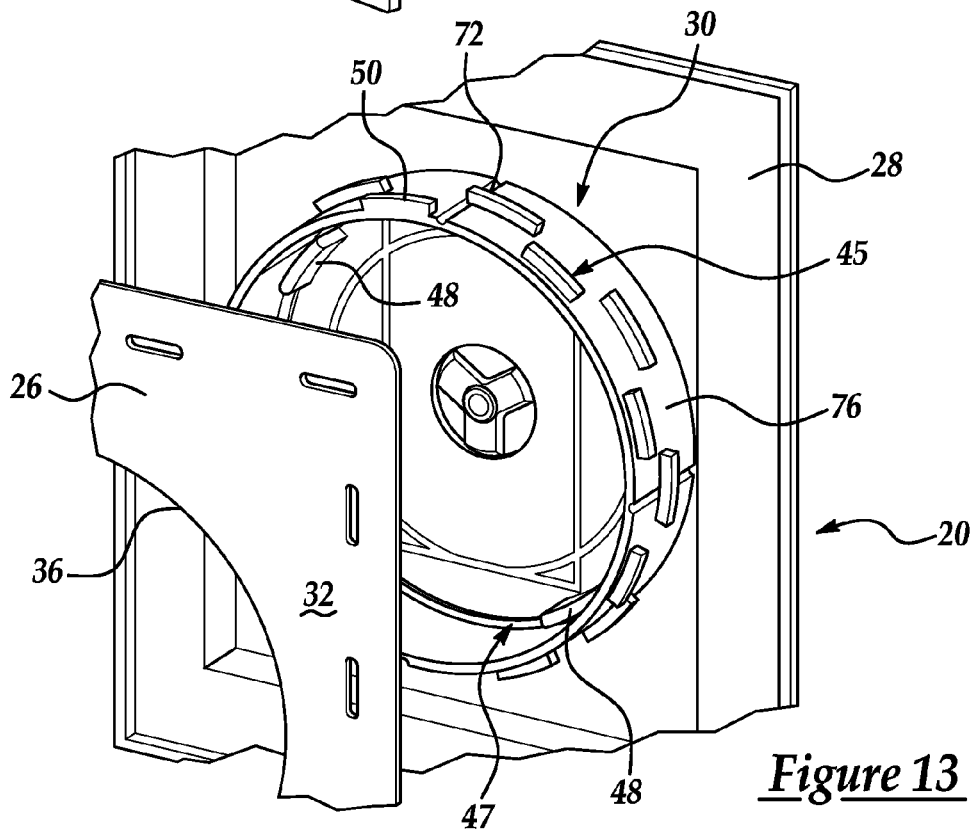
FIG. 13 is a close-up perspective view of the mounting ring connected to the front plate.
Figure 14:
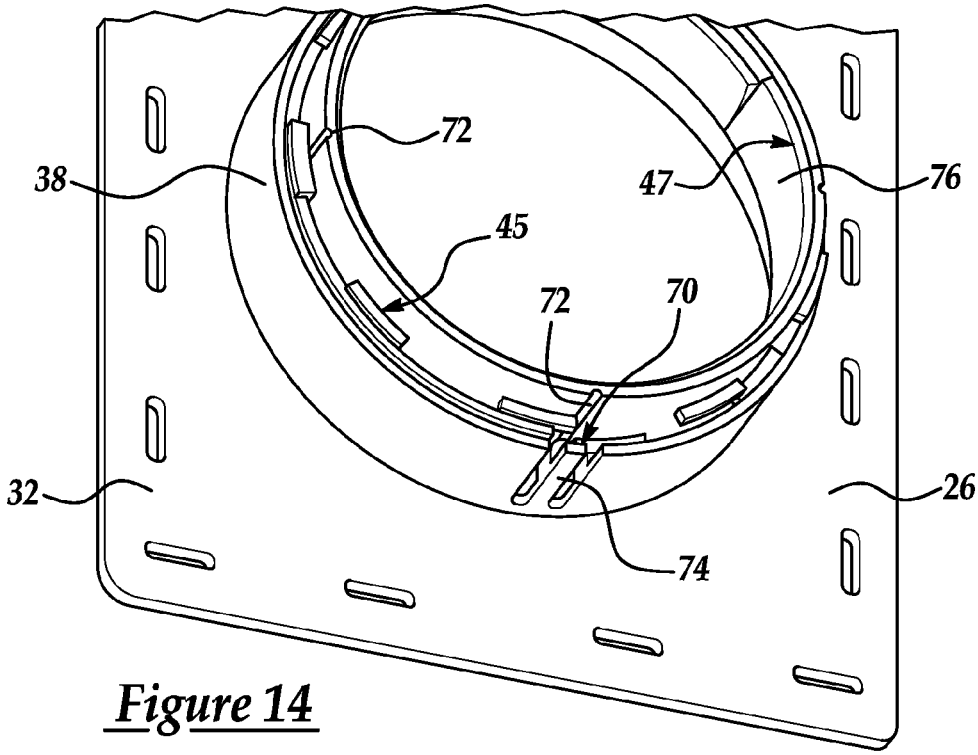
FIG. 14 is a close-up perspective view of the mounting ring connected to the back plate.
Figure 15:
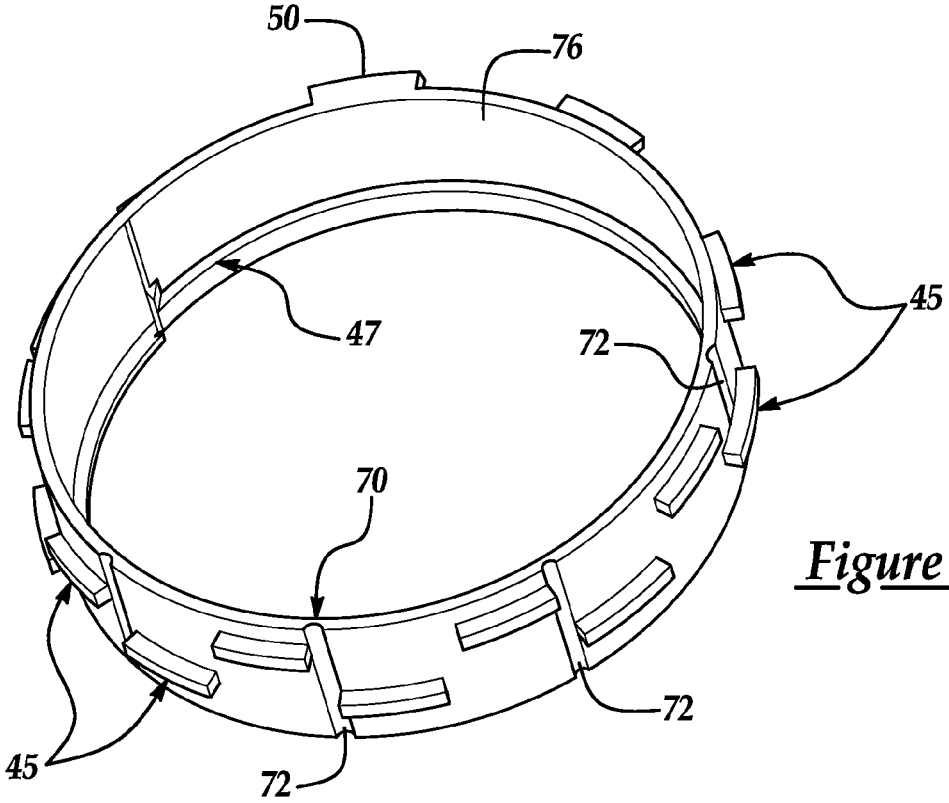
FIG. 15 is a perspective view of another embodiment of the mounting ring.

Still another embodiment of the subject invention is illustrated in FIGS. 12-16. FIG. 12 is an exploded view of this embodiment, FIG. 13 is a close-up perspective view of the mounting ring 76 connected to the front plate 28, and FIG. 14 is a close-up perspective view of the mounting ring 76 connected to the back plate 26. Referring to FIG. 15, a perspective view of the mounting ring 76 is illustrated. The female component 45 and the male component 47 of the mounting ring 76 are each threaded. The male component 47 threads of the mounting ring 76 are discontinuously spaced circumferentially about the mounting ring 76 and the female component 46 threads of the mounting ring 76 are continuously spaced circumferentially about the mounting ring 76.

Figure 16:
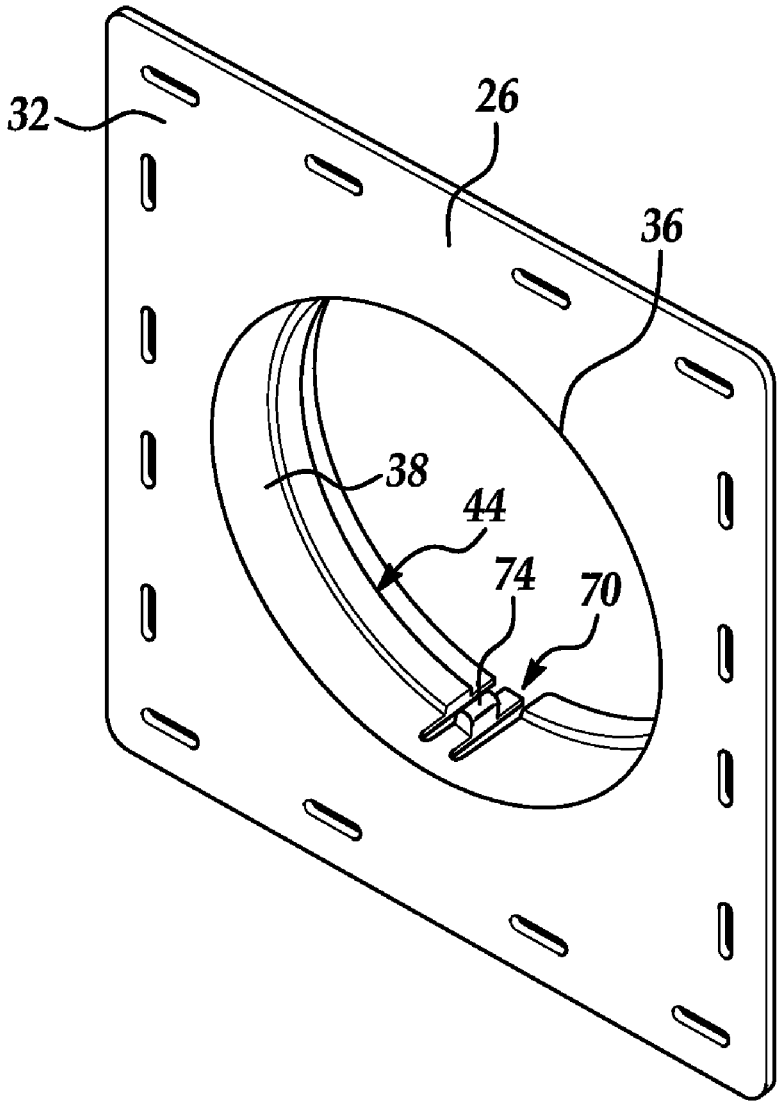
FIG. 16 is a close-up perspective view of the back plate having a securing member with a female component.

Referring to FIG. 13, the male component 43 of the attachment portion 48 is illustrated as being threaded. The threads of the attachment portion 48 may be either continuously spaced or discontinuously spaced circumferentially about the axis 34. However, it is preferred that the threads of the attachment portion 48 are discontinuously spaced. FIG. 16 is a close-up perspective view of the back plate 26 having the securing member 38 with female components 44 extending therefrom. The female components 44 of the securing member 38 are threaded. The threads of the securing member 38 are preferably continuous about the securing member 38.

Each of the threads of the mounting ring 76, the back plate 26, and the attachment portion 48 establishes a helical pattern such that relative rotation changes the distance between the plates 26, 28.

With reference back to FIG. 14, the locking mechanism 70 is illustrated as having a plurality of locking detents 72 spaced circumferentially about the mounting ring 76. Again, the locking mechanism 70 establishes various locking positions depending upon degree of rotation of the assembly 20. It is preferred that the locking detents 72 are spaced every 90 degrees, however, other angles may be desired depending upon the application. The securing member 38 has the locking finger 74 that biases inwardly for engaging the locking detents 72 when so aligned.

Obviously, many modifications and variations of the present invention are possible in light of the above teachings. The invention may be practiced otherwise than as specifically described within the scope of the appended claims.

What is claimed is:

1. An adjustable housing assembly for mounting to a wall, said assembly comprising:

a back plate for coupling to the wall, said back plate defining an axis and an aperture about said axis;

a front plate coupled to said back plate for covering said aperture;

a plurality of male and female components configured to be selectively engaged with each other, said male components extending from said front plate and said female components extending from said back plate;

said female components being discontinuously spaced about said axis;

each female component defining a plurality of locking channels spaced along said axis for selectively receiving said male components to connect said back plate and said front plate at various distances along said axis; and wherein said female portions include locking fingers on said locking channels for engaging said male portions.

2. An assembly as set forth in claim 1 wherein said male components are discontinuously spaced circumferentially about said one of said back plate and said front plate.

3. An assembly as set forth in claim 1 wherein each locking channel of said female components extends about said axis for receiving said male members in response to relative rotation between said male and female components about said axis.

4. An assembly as set forth in claim 1 wherein said female components are configured to extend from said back plate along said axis toward said front plate when said front plate is coupled to said back plate.

5. An assembly as set forth in claim 1 wherein said male components are configured to extend from said front plate along said axis toward said back plate when said front plate is coupled to said back plate.

6. An assembly as set forth in claim 1 wherein said female components are configured to extend from said back plate along said axis toward said front plate when said front plate is coupled to said back plate and wherein said male components are configured to extend from said front plate along said axis toward said back plate when said front plate is coupled to said back plate.

7. An assembly as set forth in claim 1 wherein said female components are equidistantly spaced about said axis.

8. An assembly as set forth in claim 1 wherein said male portions include locking detents for engaging said female portions.

9. An assembly as set forth in claim 1 wherein said female portions include locking fingers on said locking channels and wherein said male portions include locking detents for engaging said locking fingers.

10. An assembly as set forth in claim 1 further comprising a screen supported by said back plate and extending across said aperture.

11. An assembly as set forth in claim 10 wherein back plate includes a raised portion and wherein said screen includes tangs for engaging said raised portion.

12. An assembly as set forth in claim 1 wherein said back plate is configured to mount to an exhaust vent.

13. An adjustable housing assembly for mounting to a wall, said assembly comprising:

a back plate for coupling to the wall, said back plate defining an axis and an aperture about said axis;

a front plate coupled to said back plate for covering said aperture;

a plurality of male and female components configured to be selectively engaged with each other, said male components extending from said front plate and said female components extending from said back plate;

said female components being discontinuously spaced about said axis and being spaced about said axis in an equidistant pattern;

said male components extending from said said front plate in said equidistant pattern so that said male components align with said female components when said front plate is coupled to said back plate;

each female component defining a plurality of locking channels spaced along said axis for selectively receiving said male components to connect said back plate and said front plate at various distances along said axis; and wherein said female portions include locking fingers on said locking channels and wherein said male portions include locking detents for engaging said locking fingers.

14. An assembly as set forth in claim 13 wherein said male components are discontinuously spaced about said one of said back plate and said front plate.

15. An assembly as set forth in claim 13 wherein each locking channel of said female components extends about said axis for receiving said male members in response to relative rotation between said male and female components about said axis.

16. An assembly as set forth in claim 13 wherein said male component is configured to extend from said one of said back plate and said front plate along said axis toward the other of said back plate and said front plate when said front plate is coupled to said back plate.

17. An assembly as set forth in claim 13 wherein said female component is configured to extend from said one of said back plate and said front plate along said axis toward said other of said back plate and said front plate when said front plate is coupled to said back plate.

18. An assembly as set forth in claim 13 wherein said female component is configured to extend from said back plate along said axis toward said front plate when said front plate is coupled to said back plate and wherein said male component is configured to extend from said front plate along said axis toward said back plate when said front plate is coupled to said back plate.

19. An assembly as set forth in claim 13 wherein said female components are equidistantly spaced about said axis.

20. An assembly as set forth in claim 13 wherein said female portions include locking fingers on said locking channels for engaging said male portions.

21. An assembly as set forth in claim 13 wherein said male portions include locking detents for engaging one of said female portions.

22. An assembly as set forth in claim 13 further comprising a screen supported by said back plate and extending across said aperture.

23. An assembly as set forth in claim 22 wherein back plate includes a raised portion and wherein said screen includes tangs for engaging said raised portion.

24. An assembly as set forth III claim 13 wherein said back plate is configured to mount to an exhaust vent.

* * * * *